US005620352A

United States Patent [19]

Tzong

[11] Patent Number: 5,620,352

[45] Date of Patent: Apr. 15, 1997

[54] FLEXIBLE TUBE HAVING A NUMBER OF JOINTS

[76] Inventor: Chun-Chuen Tzong, No. 35, Avenue 6, Lane 13, Chong Ching Road, Taichung, Taiwan

[21] Appl. No.: 624,095

[22] Filed: Mar. 29, 1996

[51] Int. Cl.[6] ..... A63H 33/12; A63H 33/06; A63H 3/46

[52] U.S. Cl. ..... 446/120; 446/102; 446/383

[58] Field of Search ..... 446/120, 381, 446/383, 390, 121, 117, 102, 85

[56] References Cited

U.S. PATENT DOCUMENTS

| | | | |
|---|---|---|---|
| 2,804,721 | 9/1957 | Cohn | 446/381 |
| 4,494,417 | 1/1985 | Larson et al. | 446/383 X |
| 4,617,001 | 10/1986 | Parein | 446/120 X |
| 4,790,789 | 12/1988 | Mathis | 446/383 X |

FOREIGN PATENT DOCUMENTS

| | | | |
|---|---|---|---|
| 2274329 | 1/1976 | France | 446/120 |

*Primary Examiner*—Sam Rimell
*Assistant Examiner*—D. Neal Muir
*Attorney, Agent, or Firm*—Charles E. Baxley, Esq.

[57] ABSTRACT

A flexible tube includes a number of joint members each having a neck portion of reduced diameter formed between a spherical member and a semi-spherical member. The joint members have a hollow passage for engaging with electric wires. The spherical members each has an annular tapered surface, and the semi-spherical members each has an annular tapered surface formed in the inner peripheral portion for engaging with the annular tapered surface of the spherical member so as to limit a rotational movement of the spherical member relative to the semi-spherical member.

1 Claim, 1 Drawing Sheet

FLEXIBLE TUBE HAVING A NUMBER OF JOINTS

BACKGROUND OF THE INVENTION

1. Field of the invention

The present invention relates to a flexible tube, and more particularly to a flexible tube having a number of joints.

2. Description of the Prior Art

Typical toys comprise legs and/or hands that have flexible tubes engaged therein so as to allow the legs and/or hands to be bent. However, the flexible tubes normally comprise a solid tube configuration having no joints therein such that the legs and/or hands may not be easily bent.

The present invention has arisen to mitigate and/or obviate the afore-described disadvantages of the conventional toys.

SUMMARY OF THE INVENTION

The primary objective of the present invention is to provide a flexible tube for allowing the legs and/or the hands of the toys to be easily bent.

In accordance with one aspect of the invention there is provided a flexible tube comprising a plurality of joint members each including a spherical member and a semi-spherical member having a neck portion of reduced diameter formed therebetween, the joint members each including a hollow interior formed therein, the spherical members each including a first end distal to the semi-spherical member and having a first annular tapered surface formed thereon, the semi-spherical members each including an inner peripheral surface having a second annular tapered surface formed therein for engaging with the first annular tapered surface of the spherical member and for limiting a rotational movement of the spherical member relative to the semi-spherical member, the semi-spherical member of a first of the joint members being engaged with the neck portion of a second of the joint members so as to further limit the rotational movement of the spherical member relative to the semi-spherical member and so as to prevent the spherical member from disengaging from the semi-spherical member. The hollow interiors of the joint members form a passage for allowing an engagement of electric wires therein.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
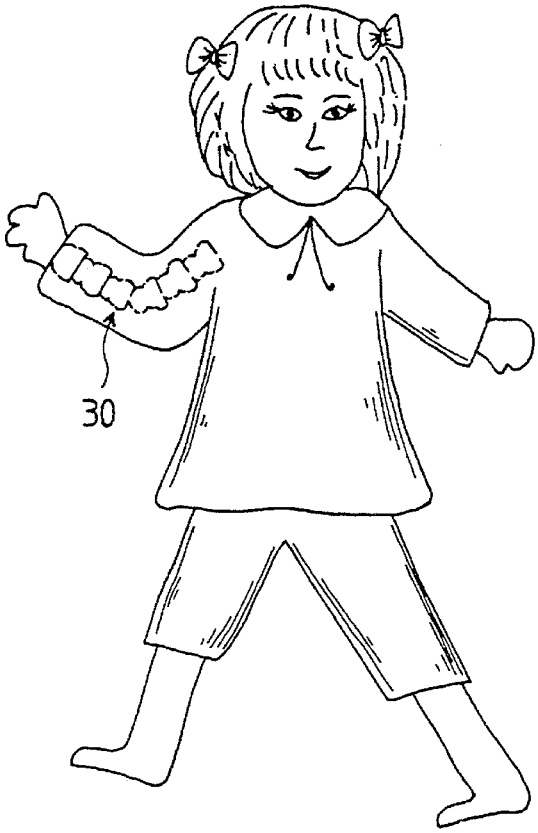
FIG. 1 is a perspective view illustrating an application of a flexible tube in accordance with the present invention.

Referring to the drawings, and initially to FIG. 1, a flexible tube in accordance with the present invention is designed and provided for engaging in the hands and/or legs of a toy so as to allow the hands and/or legs to be easily and smoothly bent.

Figure 2:
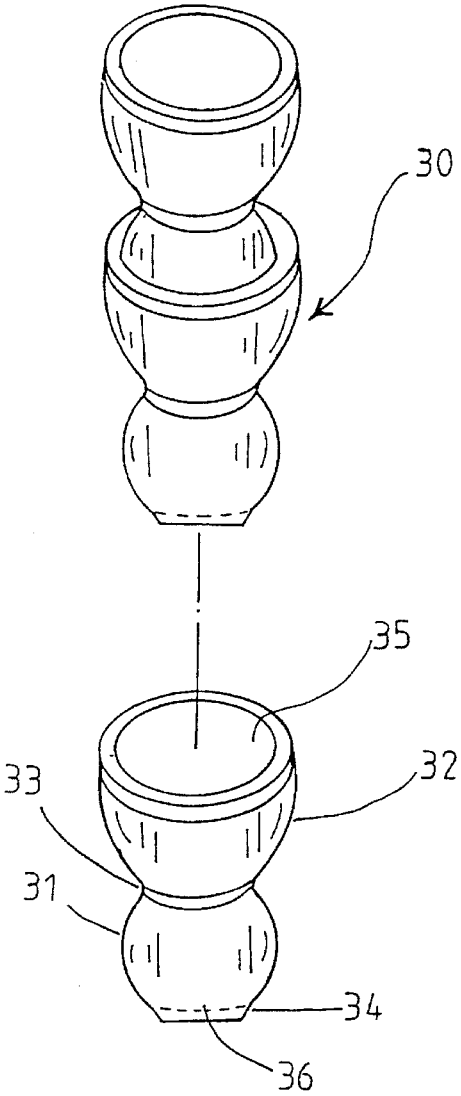
FIG. 2 is a partial exploded view of the flexible tube.
Figure 3:
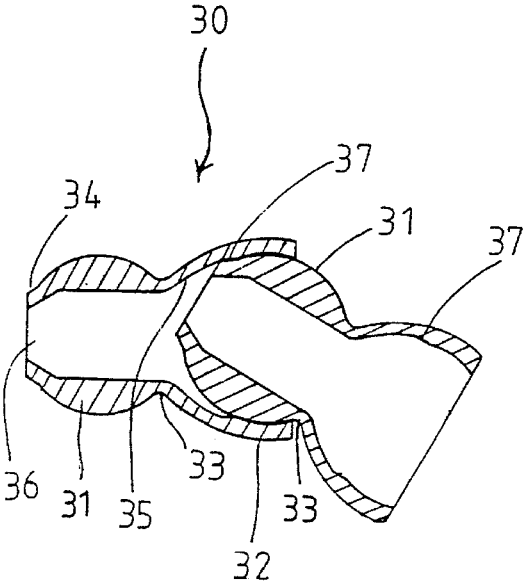
FIG. 3 is a partial cross sectional view of the flexible tube.

Referring next to FIGS. 2 and 3, the flexible tube comprises a number of joint members 30 each including a substantially spherical member 31 and a substantially semi-spherical member 32 having a neck portion 33 of reduced diameter formed therebetween. The joint members 30 each includes a hollow interior 36 formed therein. The spherical member 31 includes a first end distal to the semi-spherical member 32 and having an annular tapered surface 34 formed thereon. The semi-spherical member 32 includes an inner peripheral surface 35 having an annular tapered surface 37 formed therein for engaging with the tapered surface 34 of the spherical member 31 and for limiting the rotational movement of the spherical member 31 relative to the semi-spherical member 32, best shown in FIG. 3. As further best shown in FIG. 3, when the upper portion of the tapered surface 34 is engaged with the tapered surface 37, the neck portion 33 may be engaged with the free end portion of the semi-spherical member 32 so as to further limit the rotational movement of the spherical member 31 relative to the semi-spherical member 32 and so as to prevent the spherical member 31 from disengaging from the semi-spherical member 32.

It is to be noted that the hollow interiors 36 of the joint members 30 form a passage for allowing the engagement of electric wires therein. The engagement of the tapered surfaces 34, 37 may prevent the passage from being cut or blocked and may prevent the electric wires from being cut.

Accordingly, the flexible tube in accordance with the present invention includes a spherical member having an annular tapered surface for engaging with an annular tapered surface of a semi-spherical member so as to limit the relative rotational movement between the members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flexible tube comprising:

a plurality of joint members, said joint members each including a first end portion having a spherical member formed thereon and including a second end having a semi-spherical member formed thereon and including a neck portion of reduced diameter formed between said spherical member and said semi-spherical member, said joint members each including an interior formed therein, said spherical members each including a first end distal to said semi-spherical member and having a first annular tapered surface formed thereon, said semi-spherical members each including an inner peripheral surface having a second annular tapered surface formed therein for engaging with said first annular tapered surface of said spherical member and for limiting a rotational movement of said spherical member relative to said semi-spherical member, said semi-spherical member of a first of said joint members being engaged with said neck portion of a second of said joint members so as to further limit the rotational movement of said spherical member relative to said semi-spherical member and so as to prevent said spherical member from disengaging from said semi-spherical member, said interiors of said joint members forming a continuous passage for allowing an engagement of electric wires therein.

* * * * *